US007152388B2

(12) United States Patent
Rimondi

(10) Patent No.: US 7,152,388 B2
(45) Date of Patent: Dec. 26, 2006

(54) MOVABLE GRIPPER FOR STRETCH FILM PACKAGING MACHINES

(75) Inventor: Renato Rimondi, Bazzano (IT)

(73) Assignee: A.W.A.X. Progettazione E Ricerca S.r.l. (IT)

( * ) Notice: Subject to any disclaimer, the term of this patent is extended or adjusted under 35 U.S.C. 154(b) by 18 days.

(21) Appl. No.: 10/505,364

(22) PCT Filed: Mar. 17, 2003

(86) PCT No.: PCT/EP03/02772

§ 371 (c)(1),
(2), (4) Date: Aug. 24, 2004

(87) PCT Pub. No.: WO03/080444

PCT Pub. Date: Oct. 2, 2003

(65) Prior Publication Data

US 2005/0081491 A1 Apr. 21, 2005

(30) Foreign Application Priority Data

Mar. 27, 2002 (IT) ..... BO2002A0154

(51) Int. Cl.
*B65B 53/00* (2006.01)
*B65B 41/12* (2006.01)

(52) U.S. Cl. ..... 53/556; 53/441; 53/228

(58) Field of Classification Search ..... 53/556, 53/228, 230, 222, 223, 232, 64, 66, 441, 53/461; 294/902
See application file for complete search history.

(56) References Cited

U.S. PATENT DOCUMENTS 3,967,433 A * 7/1976 Bonfiglioli ..... 53/441
4,501,105 A * 2/1985 Rogers et al. ..... 53/64
4,501,106 A * 2/1985 Treiber et al. ..... 53/66
4,505,092 A 3/1985 Bowers et al.
4,958,479 A * 9/1990 Treiber ..... 53/441
5,115,620 A 5/1992 Takamura
5,383,326 A * 1/1995 Dean et al. ..... 53/556
5,595,042 A 1/1997 Cappi et al.

(Continued)

FOREIGN PATENT DOCUMENTS

EP 0 890 508 1/1999

*Primary Examiner*—Stephen F. Gerrity
*Assistant Examiner*—Paul Durand
(74) *Attorney, Agent, or Firm*—Stites & Harbison PLLC; Marvin Petry

(57) ABSTRACT

An upper jaw of the gripper is provided posteriorly to a fulcrum shaft, with opposed portions for a double effect cooperation with an eccentric element keyed on the shaft which controls the orientation of the gripper. The opening and closure movement of the gripper, in an appropriate phase of the distributor (D) of the film, is ensured by the cooperation of a roller of an action lever of the fulcrum shaft with a cam-function lever, horizontally fulcrumed with one end of a support fixed to the frame of the machine and provided on the other end with a trigger and hook device which, when actuated by the roller, deactivates and allows the lifting of the lever via an elastic return device. Subsequent to the lifting, the gripper closes and grasps the film from the distributor. During the opposite displacement run of the gripper from the distributor, a cam fixed to the carriage with the gripper, co-operates with a lateral arm of the lever with the function of cam, and causes the lowering of the latter in the original position, with re-loading of the relative trigger and hook device.

10 Claims, 3 Drawing Sheets

U.S. PATENT DOCUMENTS 6,018,930 A * 2/2000 Rimondi et al. ..... 53/228
6,170,236 B1 * 1/2001 Whitby et al. ..... 53/441
6,189,302 B1 * 2/2001 Kudo et al. ..... 53/556
6,658,820 B1 * 12/2003 Whitby et al. ..... 53/441
6,895,728 B1 * 5/2005 Kondo ..... 53/441

* cited by examiner

MOVABLE GRIPPER FOR STRETCH FILM PACKAGING MACHINES

FIELD OF THE INVENTION

The present invention relates to functional and constructive improvements in a movable gripper for machines intended to package products with a stretchable film.

BACKGROUND OF THE INVENTION

Machines for packaging products with stretchable film include the one described in the Italian patent 1.262.267, belonging to the same applicant, herein incorporated by reference. In these type of machines, the packaging film is supplied by a fixed and horizontal distributor which is comb-shaped and usually placed under horizontal rollers which fold the last edge of the portion of the packaging film under the product previously retained by the distributor, while the same product is translated to the discharge portion of the machine by a pusher installed on the posterior folder. Under this posterior folder a comb-shaped gripper is installed, in an oscillating manner, parallel to the same folder, complementary to the combs of the distributor, which is oriented toward the distributor's comb, with its teeth and by suitable means, can be opened or closed and can be carried from a horizontal, raised position, to a lowered and downwardly inclined position, and vice-versa. When the carriage with the posterior folder performs its approach run to the distributor, the gripper is initially in a raised position and the gripper is closed. Then, the gripper is opened and downwardly inclined in such a manner to fit the teeth of the comb distributor which has left the last edge of the packaging film of the product being discharged and now is supporting the new head of the film which will envelope the following product. At the end of the run of the posterior folder, the gripper closes and grasps the head of the film supported and guided by the distributor. When the posterior folder performs the displacement run from the distributor, the gripper remains closed and initially in a low position to extract the film from the distributor. Subsequently, the gripper is raised horizontally to be pre-arranged for the repetition of a new packaging cycle.

In the gripper according to the prior art, the lower jaw is pushed upwardly by a flat spring which results in difficulty during pre-loading. Difficulties include undesired friction which may lead to possible poor reliability.

In the gripper according to the prior art, in all instances, the opening oscillation movement of the lower jaw, is ensured by the co-operation of a lever keyed on the fulcrum shaft of the jaw, with an oscillating cam pre-arranged on an axle parallel to the working run of the gripper and which is normally maintained in the vertical position by elastic means. When the lever arrives in the final portion of the profile of the cam, the lever comes up against a recess (step) which causes the gripper to close on the film distributor and the end of the same lever is positioned on a laterally inclined portion of the cam, so that when the gripper is moved away from the distributor, the lever causes the cam to oscillate or pivot around its own fulcrum. This action causes remarkable sliding friction between the pin of the lever arm and the cam, makes the active positioning of the same cam unstable and it is not well-suited for the speed and for the high working cycles of the packaging machine.

In all prior devices, the raising and lowering movement of the gripper is ensured by the co-operation of an extension beyond the fulcrum of the stem of the upper jaw of the same gripper, with a little and overhanging cam provided with two consecutive eccentricities, placed with an angular distance between them of about—30–45° and therefore with a steep and short fall between the two eccentricities. This configuration causes concentrated and quick wear of the cam and it is not suitable for the speed and the high working cycles of the packaging machine. Further, the gripper can freely upwardly oscillate.

SUMMARY OF THE INVENTION

One object of the present invention is to overcome the drawbacks of prior packaging machines with the use of a helical pin spring.

Another object of the present invention is the use of new cam which provides a more reliable packaging machine which does not have the sliding frictions of prior machines.

A third object of the present invention is to overcome the drawbacks of prior machines by pre-arranging the gripper for a double-effect co-operation with opposite points of a single-eccentricity cam, where this cam acts by means of rolling friction and where this cam can be actuated with oscillations up to about 120–180°, with a gradual progression, all not obtainable with the prior art machines.

BRIEF DESCRIPTION OF THE DRAWINGS

These and other features of the improvements which are referred to and the advantages deriving therefrom, will appear better evident from the following description of a preferred embodiment of the same, made by way of a non-limiting example, with reference to the figures of the attached sheets of drawings, in which.

DETAILED DESCRIPTION

Figure 1:
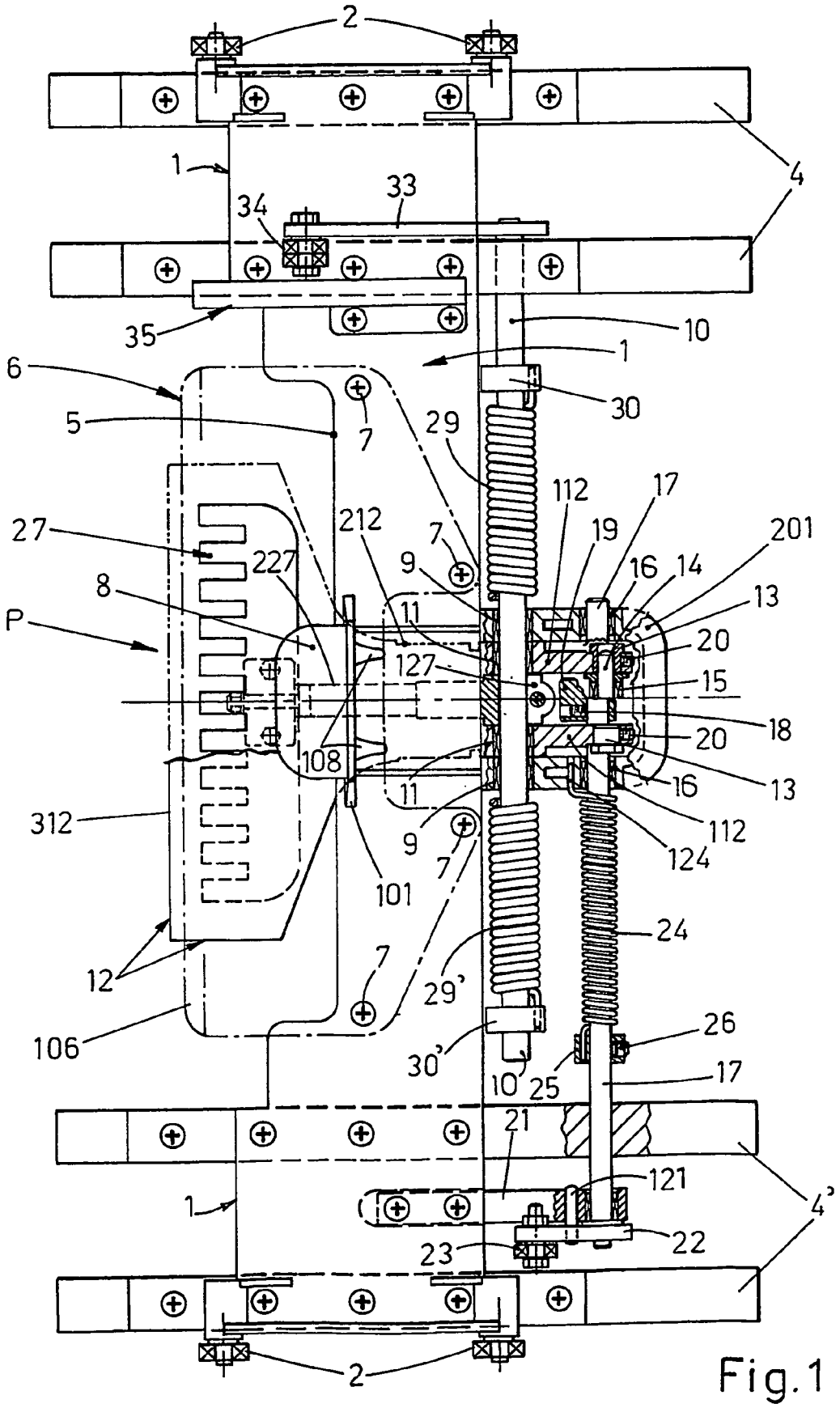
FIG. 1 is a plan view from the top and with portion in section of the gripper which is referred to, taken in the stretching end run position of the film in the packaging station.
Figure 3:
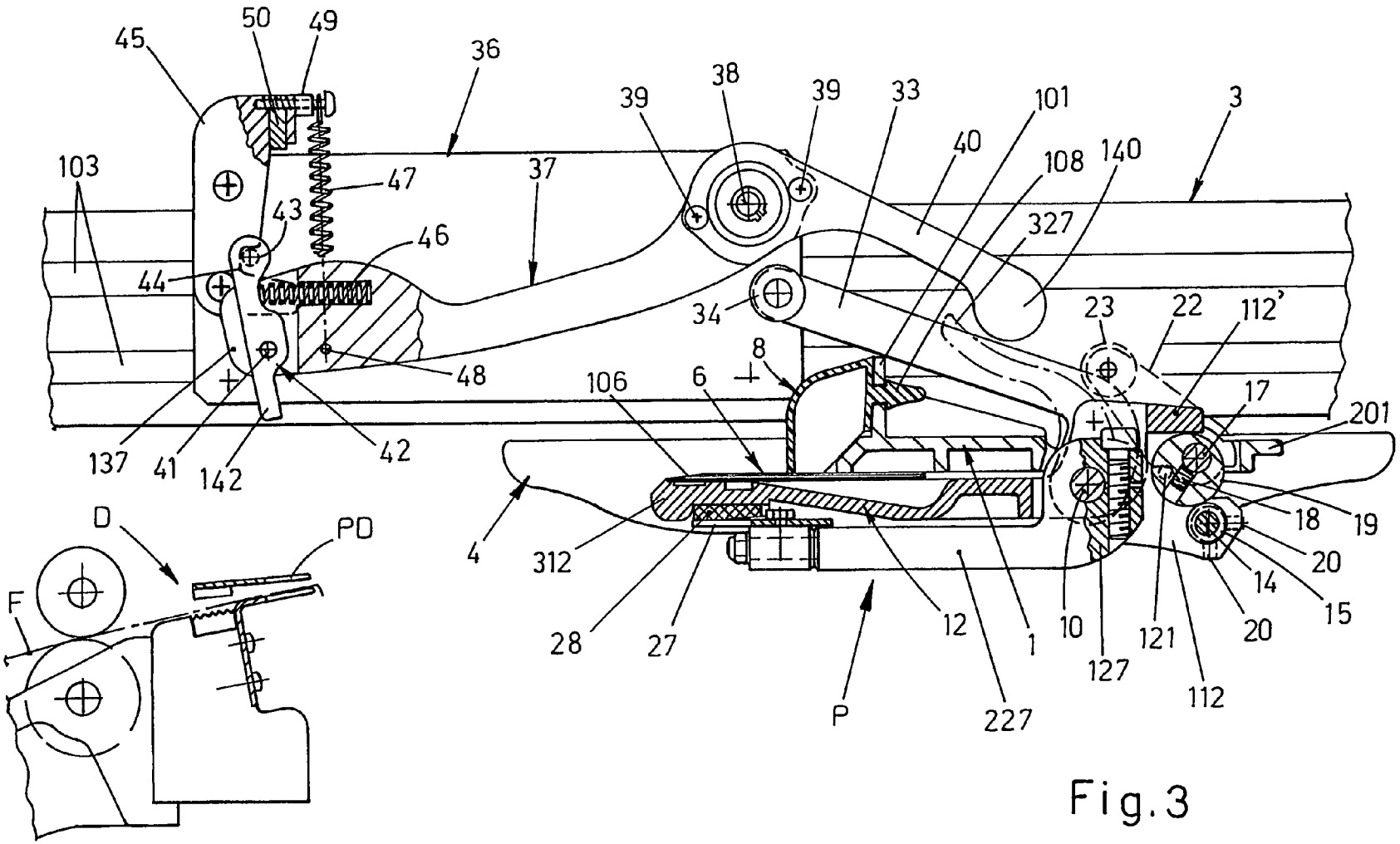

In FIGS. 1 and 3, carriage 1 carries the posterior folder, the pusher and the mobile gripper for the clamping of the film. The carriage 1 has, for example, a flat conformation, which has a lower ribbed portion, and substantially rectangular shape. Small wheels 2 are provided at the ends of the carriage 1, which run in corresponding horizontal slots, (not shown), fixed to the frame of the machine and parallel to the rectilinear actuator 3 visible in FIG. 3, driven by a step motor controlled by a computer of the machine and to the movable element of which is connected in a known manner. With numeral references 4, 4' there are shown the pairs of slide cams which run in corresponding horizontal guides, of known type, which act on the lateral grippers of the packaging machines and which are not further described as such a description is unrelated to the understanding of the present invention.

The front of the carriage 1, which is turned in the discharging direction of the packaged product, is provided with a wide symmetrical recess 5 which is occupied by the flat and posterior folder 6, shown with dash and dot line of FIG. 1, fixed with screws 7 and made with any suitable and/or, if required, treated material in such a manner to have a low coefficient of friction with respect to the packaging film and whose anterior edge 106, which is conveniently projecting from the carriage 1 and which is parallel to this one, is suitably bevelled. The carriage 1 carries integral, under the folder 6 and in median position, a small raised wall 101 which has a ribbed surface, provided with a pair of through holes to which may be pressure coupled the connection appendices of a little rubber cap, downwardly open, which is partially surmounting the folder 6 and which acts like a yielding hold up or contrast means to posteriorly push the product during the finishing phase of the packaging and during the translation toward the discharging station of the machine.

The carriage 1 carries integrally, in middle position and projecting in a direction which is opposite to the folder 6, a small horizontal and annular appendix 201. Lateral of the appendix 201 rotatably support a first shaft 10 with small bushings 9. The first shaft 10 is horizontal and parallel to the anterior edge 106 of the folder. On the portion of the shaft 10 which is placed inside of the support ring 201, there are rotatably assembled, with small bushes 11, the lateral walls of the forked terminal end 112 of the stem 212 of the upper, ribbed and flat jaw 12 of the gripper P. The flat jaw 12 has, in plan view, a substantially rectangular shape. The flat jaw 12 is posteriorly connected to the stem 212 with a symmetrically tapered conformation and jaw 12 is provided with a rectilinear anterior edge 312, having a rounded shape and which incorporates the anterior edge of the folder 6 when the gripper is raised.

The fork terminal end 112 of the upper jaw 12 of the gripper P supports, with the interposition of eccentric bushes 13, the ends of a pivot 14 which is parallel to the shaft 10 and upon which there is rotatably assembled a bearing 15. An end portion of the shaft 17 is rotatably supported in a position parallel to the same shaft 10 by the interposition of bushes 16. An eccentric element 19 made of suitable material is keyed by means of a grub screw 18. The eccentric element 19 has a cylindrical shape, which co-operates, on one side with an upper bar 112' of the fork terminal end 112 and which, with another portion, which forms substantially an angle of 180° with respect to the bar, co-operates with the above mentioned bearing 15. The cooperation of both parts of eccentric element 19 is such that rotating the shaft 17 results in the eccentric element 19 causing the lowering or the raising of the upper jaw of the gripper P, with a double control effect. The eccentric bushings 13 are provided with fixing radial grub screws 20, through which it is possible to ensure a better contact position of the bearing 15 with the eccentric element 19, as well as accommodate the presence of possible working tolerances of the various portions which compose the gripper P. The fork terminal end 112 is provided between the bar 112' and the small support portion of the pin 14, and with wide side grooves avoid interference between the same fork terminal end 112 and the shaft 17. As shown in FIGS. 1 and 3, the shaft 17 has a length which is sufficient to rotatably traverse one of the lateral cams 4' of the carriage 1. A small support 21 is placed under the fix cam and is fixed to the carriage 1. A small lever 22 is square keyed on the end of the same shaft 17. The small level 22 is oriented high and in the direction of the folder 6. A lateral roller 23 is attached to the lever 22 on an end opposite the shaft 17. The lateral roller 23 has an axis of which is parallel to the shaft 17. On the portion of the shaft 17 which runs between the cam 4' and the support ring 201, there is wound a needle spring 24. The needle spring 24 is anchored to a wall of the ring 201 of the carriage 1 via end 124. The other end of spring 24 is anchored to a bush 25. Bush 25 is fixed with a grub 26 on the same shaft 17. The spring 24 is pre-loaded in such a manner to maintain the lever 22 against a lower retainer 121, integral with the support 21. In these conditions, the eccentric element 19 is in the position of FIG. 3 and maintains the upper jaw of the gripper P raised against the folder 6.

Figures 2, 4:
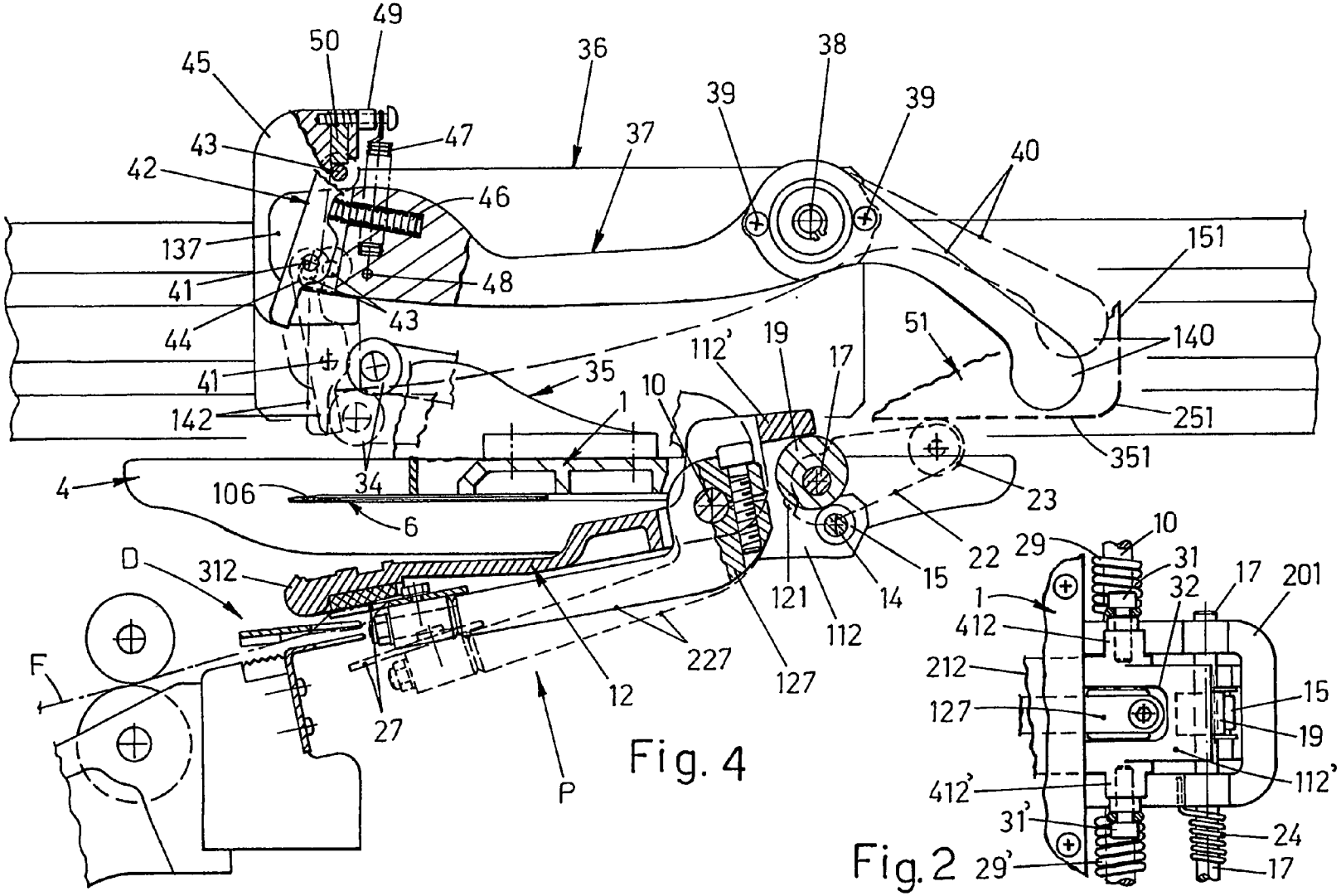
FIG. 2 is a top view of the posterior and middle portion of the gripper connected to the opening-closing and lifting-lowering shafts of the same gripper.
FIGS. 3 and 4 are lateral views and with portions in section of the gripper respectively in the upper and closed position, when it arrives at the level of the opening means and at the end of the co-operation run with the opening means, when it stops to grip the film from the distributor and to begin the reverse translation run, to stretch a new portion of film in the packaging station.

From FIGS. 1, 2, and 3, it is noted that on the portion of the shaft 10 which is between the lateral walls of the posterior fork 112 of the stem of the upper jaw 12, the stem 227 of the lower jaw 27 of the gripper P, is fixed with its structural clamp end 127. The comb-shaped gripper P, when it is in the closing position, touches, with its teeth, a strip 28 of material with a high coefficient of friction, for example rubber, fixed on the lower face of the upper jaw 12 of the same gripper P. The lower gripper 27 is normally urged in closure by a couple of needle springs 29, 29' which wind around portions of the shaft 10 which are laterally projecting from the ring 201 of the carriage 1. These externally projecting portions are anchored with respective external ends to bushings 30, 30'. Bushing 30, 30' are fixed with grubs to the same shaft 10. The opposite end of the springs 29, 29' are anchored to the posterior fork 112 of the stem of the upper jaw using screws 31, 31', with lateral ledges 412, 412'. The springs 29, 29' are advantageously pre-loaded to urge the two jaws of the gripper P against one another with an appropriate thrust.

FIG. 2 shows how the posterior fork 112 is superiorly provided with a window 32 through which it is possible to act on the screw of the clamp 127, which fixes to the shaft 10, the stem of the lower jaw 27 of the gripper P. Through this window, there projects an appendix 327 which is bent upwards, onto which the operator can act to lower the inferior jaw 27 each time that this operation is required.

The shaft 10 passes, in a rotatable manner, through one of the internal cams 4 which is integral with the carriage 1. Shaft 10 includes a lever 33 at one end which is keyed and oriented in the same direction as the lever 22. A lateral roller 34 is provided at the end of lever 33. The axis of the lateral roller 34 is parallel to the shaft 10. A cam 35 is fixed on carriage 1, laterally to the roller and upwardly oriented.

The actuator 3 is placed on the side of the carriage 1 which carries the lever 33. Taking advantage of the lateral grooves 103 of the body of the actuator, upon this is laterally fixed a base 36 which carries the mechanisms (described below) to actuate the opening and then the closure of the described gripper when the carriage 1 reaches the expulsion end run of a packaged product and when the same gripper P arrives to co-operate with the known type distributor D, to clamp from this the new head of the film which must be stretched in the packaging station of the machine during the next return run of the same carriage 1.

From FIG. 3 it is noted that, when the carriage 1 reaches the position where gripper P begins to open, the roller 34 of the lever 33 begins to co-operate with the lower side of a lever 37 downwardly inclined, placed with its longitudinal axis on an ideal vertical plane which is parallel to the run of the carriage 1 and articulated with one end on a pin 38 fixed to the plate 36 and parallel to the shaft 10. On the same end of the fulcrum, the lever 37 carries laterally fixed, by means of the screws 39, a lever arm 40 downwardly oriented, in the opposite direction with respect to the lever 37 and which terminates with a rounded end 104 placed on the sliding path of the cam 35 fix to the carriage 1. When the lever 37 is in the active position shown in FIG. 3, the end 140 of the lever arm 40 is raised and does not interfere with the cam 35. The lever 37 includes a laterally flattened portion 137, on an end of the lever 37, opposite to the end 140. Flattened end portion 137 is parallel to the fulcrum fulcrumed at 41. A short lever 42 is parallel to the fulcrum 38. Short lever 42 has a lower portion 142 which projects downwardly from the lever 37 to act as a trigger. An upper portion projects upwardly from the lever 37 to act as a trigger or hook. An upper end of the lever 42 has a horizontal pin 43 which engages a lateral recess 44 of a small vertical guide 45 fixed upon a small plate 36.

A return spring 46 is housed in a seat formed on the base of the recess 137 of the lever 37. The return spring 46 acts on the upper arm of the lever 42, to maintain the small pin 43 inside of the recess 44. A second return spring 47 is laterally anchored at 48 to the lever 37 on one end, and anchored to an appendix 49, of the upper portion of the guide 45, at the other end the level of which the same guide is provided with a projecting step 50. The anchoring is achieved, partially realized with an elastic-yielding material.

When the roller 34 of the lever 33 runs along the lower and descending side of the lever 37, the shaft 10 of the gripper oscillates or pivots in a counterclockwise direction, as shown in FIGS. 1 and 3, and the lower jaw 27 of the gripper P oscillates or pivots downwardly and moves away from the upper jaw 12, opening the same gripper.

In a correct phase with the above mentioned opening phase, the gripper P oscillates or pivots downwardly to reach the same level of the complementary gripper PD of the distributor D which retains the new head of the packaging film F. To accomplish this function, a cam 51 is fixed to the frame of the machine, against a vertical edge. The cam 51 co-operates with the roller 23 of the lever 22, in such a manner that the translation of the carriage 1 causes the roller to first goes up on the front 151 of the cam, then to go down, then to run along the rounded corner zone 251 of the same cam and finally to run along the lower (inferior) and horizontal side of the same cam 51. As a consequence of this wide movement of the lever 22 and of the relative shaft 17, the eccentric element 19 rotates in a clockwise direction (as shown in FIGS. 1 and 4) and the whole gripper P is lowered while remaining opened and disposes with the upper jaw 12 and with the lower jaw 27, respectively, over and under the gripper PD of the distributor D. When the carriage 1 is about to traverse the last portion of its run (e.g. a few millimeters) towards the distributor D, the roller 34 of the lever 33 touches the lower trigger 142 of the lever 42 and urges the lever to rotate in a clockwise direction (as shown in FIG. 3), resulting in the disengagement of the pin 43 from the recess 44, in contrast with the spring 46, so that by effect of the traction performed by the spring 47, the lever 37 oscillates rapidly upwardly (as shown in FIG. 4), causing the rising of the lower jaw 27 of the gripper P. The teeth of the lower jaw 27 pass through the empty spaces of the comb PD of the distributor and raise the head of the film F, clamping the same firmly against the rubber strip 28 of the upper jaw 12. The pin 43 runs on the side of the guide 45 and arrives against the elastic rubber bumper 50. With the raising of the lever 37, the lower (inferior) side of the lever has been moved over the roller 34 of the lever 33, while the lever arm 40 has been lowered and its end 140 has been carried to the level of future co-operation with the cam 35.

When the run of the carriage 1 is reversed and the gripper P moves away from the distributor, with a movement toward the right (as shown in FIG. 4), the same gripper P remains closed and remains low to be withdrawn from the gripper PD of the distributor D. When the roller 23 of the lever 22 is moving backwards passing the lower (inferior) side 351, the corner zone 251 and then the front 151 of the cam 51, the gripper P will come out from the distributor D and gradually returns in the high position of FIG. 3, with the conclusion of its lifting when the roller 34 has gone beyond the fulcrum zone 38 of the lever 37, in such a manner that the gripper must change its position while the gripper always remains closed. When the cam 35 passes under the end 140 of the lever 40, the lever is raised, causing the lowering of the lever 37, while the lever 42, with the functions of hook and trigger, is reloaded as from FIG. 3, preparing the whole mechanism for the repetition of a new working cycle.

It is to be understood that the end 140 of the lever 40 may be provided with a roller for the co-operation with rolling friction with the cam 35. For the same objects, also the upper bar 112' of the posterior fork 112 of the upper gripper, may be provided with a roller for the co-operation with rolling friction with the eccentric element 19, even if the eccentric element works preferably in contact with the lower bearing 15.

The invention claimed is:

1. A movable gripper for machines for the packaging of products with stretchable film, placed under a posterior folder having a pusher for the expulsion of the packaged product, disposed on a horizontal translation carriage, said movable gripper comprising:

a flat upper jaw, supported by a forked arm, said forked arm pivotally mounted upon a forked arm shaft, said forked arm shaft being horizontal and parallel to said carriage and rotatably supported by at least a pair of parallel supports interconnected to the median and lower portion of the carriage;

a lower jaw supported by a lower jaw arm, said lower jaw arm fixed on said forked arm shaft;

a first square lever with a lateral appendix disposed at an end of said forked arm shaft, said first square lever for the co-operation with a cam for the opening and closing operations of a first gripper;

an eccentric element keyed on a support shaft, parallel to the forked arm shaft, said eccentric element for maintaining the support shaft horizontally or for lowering the support shaft, said support shaft rotatably supported by one of the pair of parallel supports; and a second square lever located at an end of the support shaft for co-operation with the cam which the second square lever contacts during movement of the carriage, wherein said eccentric element cooperates with a portion of said upper jaw extending laterally away from said first gripper and a forked portion of the stem of the upper jaw to control oscillation of the first gripper around the forked shaft.

2. The gripper according to claim 1, wherein said eccentric element comprises a cylindrical and round section body having a hole, eccentrically positioned and parallel to a longitudinal axis of the eccentric element, and the support shaft, upon which the eccentric element is fixed, passing through the hole.

3. The gripper according to claim 1, wherein the eccentric element contacts a bar integral to a lateral portion of the fork arm, said fork arm supports in opposition to said bar and with the interposition of regulation eccentric means, a pin parallel to the support shaft with the eccentric element and upon which there is rotatably assembled a roller or bearing which co-operates by rolling friction with a lower portion of said eccentric element.

4. The gripper according to claim 3, wherein the bar which co-operates with the upper portion of an eccentric element, rotatably supports a roller or a co-operation means with rolling friction with the eccentric element.

5. The gripper according to claim 1, wherein the support shaft is rotatably supported at an end of the support shaft opposite said eccentric element, by means of an eccentric element support placed at the level of a side of the carriage to which said eccentric element support is fixed and on an end of the support shaft which is projecting from said eccentric element support, there is fixed said second square lever upwardly oriented and toward the first gripper, provided at the end with a roller, wherein when said second square lever, in its rest position, is pushed by the action of an elastic means resting on a lower retainer integral with said eccentric element support, the eccentric element provides an eccentricity force downwardly oriented and the upper jaw of the first gripper is raised and in contact with the overhanging posterior folder.

6. The gripper according to claim 5, wherein the elastic means comprises a pre-loaded needle spring which is wound on a portion of said support shaft, said elastic means anchored on one end to a bush fixed on the support shaft and anchored with the other end to one of the pair of parallel supports of the carriage which rotatably carries the support shaft and the forked shaft of the first gripper.

7. The gripper according to claim 1, wherein during the translation of the carriage, moving close to a distributor of the film, an end roller of the second square lever moves to co-operate with a front of a fixed cam, upon which front the same roller progressively goes up raising said second square lever in a vertical position and then lowers while said second square lever continues in a backwards rotation, afterwards said roller co-operates with a beveled corner zone of said cam and finally runs along a horizontal lower side of the cam, while said second square lever remains backwardly oriented, in the condition in which the eccentric element is upwardly oriented with respect to the major eccentricity of said eccentric element and with the upper jaw and lower jaw downwardly oriented, in the correct position for the co-operation with a distributor of the film.

8. The gripper according to claim 1, wherein the forked arm shaft has projection portions, on respective ends, which extend from a small annular frame of one of the pair of parallel supports, and further comprising needle springs wound on said projecting portions and pre-loaded with a force, a first end of each said needle spring anchored to bushings fixed to said forked shaft, and a second end of said needle springs anchored to a terminal fork portion of the forked arm whereby the two jaws of the gripper are forced against each other by said springs.

9. The gripper according to claim 8, wherein the first square lever is provided at one end with a lateral roller parallel to said forked arm shaft and that during the translation of the carriage, when it is required that the upper jaw separates from the lower jaw, said lateral roller runs along the lower side of a third lever downwardly oriented, said third lever pivotal along an axis parallel to said forked arm shaft, a lower end of said third lever being provided with a lateral recess, an inter-pivotal point defined by a fourth lever projecting under the first lever with an extension portion acting as a trigger, placed in the path of said lateral roller and which projects upwardly from said fourth lever with a portion having the function of a hook, provided with a lateral appendix which, via an elastic element is pushed to engage a lateral recess of a small vertical and fixed guide and via elastic means to upwardly urge said third lever in such a manner that when said lateral roller co-operates with said third lever, the lower jaw of a first gripper is moved away from the upper jaw and when the first gripper has arrived opened and in a low position in co-operation with a distributor gripper of a distributor of the film, said lateral roller co-operates with the extension portion of the fourth lever and causes the disengagement of the hook of this one by the recess, so that said third lever, is raised by the action of said elastic means and is stopped with the hook against an elastic bumper, while the lower jaw of the first gripper is raised and carries the head of the film retained by a comb of the distributor, to be fixed between the teeth of said lower jaw, and a strip of rubber of the upper jaw of the first gripper, means being provided to re-load in the downwardly inclined position said third lever with the function of the cam, as soon as said lateral roller has gone beyond said third lever during a displacement run of the first gripper from the distributor.

10. The gripper according to claim 9, wherein said third lever is disposed in a position which does not interfere with the lateral roller and with said first lever during the opening and closing movement of the first gripper, a short fifth lever arm is downwardly oriented and having a rounded end or provided with a roller, with which is co-operating a cam fixed to the carriage which provides re-loading of said fifth lever to function as a cam during the displacement run of the first gripper from the film distributor.

* * * * *